US008767009B1

(12) United States Patent
Guy

(10) Patent No.: US 8,767,009 B1
(45) Date of Patent: Jul. 1, 2014

(54) METHOD AND SYSTEM FOR RECORD-TIME CLIPPING OPTIMIZATION IN DISPLAY LIST STRUCTURE

(75) Inventor: Romain Guy, Millbrae, CA (US)

(73) Assignee: Google Inc., Mountain View, CA (US)

( * ) Notice: Subject to any disclaimer, the term of this patent is extended or adjusted under 35 U.S.C. 154(b) by 192 days.

(21) Appl. No.: 13/545,480

(22) Filed: Jul. 10, 2012

Related U.S. Application Data

(60) Provisional application No. 61/664,708, filed on Jun. 26, 2012.

(51) Int. Cl.
*G09G 5/00* (2006.01)

(52) U.S. Cl.
USPC ..... 345/620

(58) Field of Classification Search
CPC ..... G06T 15/30
USPC ..... 345/620
See application file for complete search history.

(56) References Cited

U.S. PATENT DOCUMENTS

| | | | | |
|---|---|---|---|---|
| 4,679,038 | A * | 7/1987 | Bantz et al. | 345/553 |
| 4,821,209 | A * | 4/1989 | Hempel et al. | 345/625 |
| 5,315,696 | A * | 5/1994 | Case et al. | 345/522 |
| 5,821,940 | A | 10/1998 | Morgan et al. | |
| 5,959,867 | A * | 9/1999 | Speciner et al. | 700/219 |
| 6,166,724 | A * | 12/2000 | Paquette et al. | 345/537 |
| 6,512,524 | B1 * | 1/2003 | Mang | 345/622 |
| 6,701,420 | B1 * | 3/2004 | Hamilton et al. | 711/170 |
| 7,167,976 | B2 * | 1/2007 | Poznanovic | 713/1 |
| 2001/0024285 | A1 * | 9/2001 | Kondo | 358/1.1 |
| 2004/0217966 | A1 * | 11/2004 | Lefebvre et al. | 345/553 |
| 2005/0187898 | A1 * | 8/2005 | Chazelle et al. | 707/1 |
| 2005/0264589 | A1 * | 12/2005 | Kimoto et al. | 345/698 |
| 2006/0077210 | A1 * | 4/2006 | Morris et al. | 345/613 |
| 2007/0162866 | A1 | 7/2007 | Matthews et al. | |
| 2010/0315431 | A1 * | 12/2010 | Smith et al. | 345/619 |
| 2011/0255098 | A1 * | 10/2011 | Ito | 358/1.2 |
| 2011/0304608 | A1 * | 12/2011 | Yang | 345/419 |
| 2012/0089827 | A1 * | 4/2012 | Reynolds et al. | 713/2 |

* cited by examiner

*Primary Examiner* — Kee M Tung
*Assistant Examiner* — William Beutel
(74) *Attorney, Agent, or Firm* — McDonnell Boehnen Hulbert & Berghoff LLP

(57) ABSTRACT

Outcome of one or more operations (e.g., clipping operations) performed during handling of a drawing command that is repeated in a series of lists of commands (e.g., series of display lists) may be determined based on preconfigured control information associated with the particular drawing command. In this regard, the control information may be set and/or configured during generation of the series of lists of commands. Determining the outcome of the one or more operations may enable determining whether to skip (or not) the drawing command. The control information may be combined with and/or incorporated into the drawing command itself. Alternatively, separate structures (e.g., lookup tables) may be used to store the control information and associate the control information with the drawing command(s).

27 Claims, 6 Drawing Sheets

METHOD AND SYSTEM FOR RECORD-TIME CLIPPING OPTIMIZATION IN DISPLAY LIST STRUCTURE

CLAIM OF PRIORITY

This patent application makes reference to, claims priority to and claims benefit from U.S. Provisional Patent Application Ser. No. 61/664,708, filed on Jun. 26, 2012.

The above stated application is hereby incorporated herein by reference in its entirety.

TECHNICAL FIELD

Aspects of the present disclosure relate to electronic devices. More specifically, certain implementations of the present disclosure relate to record-time clipping optimization in display list structures.

BACKGROUND

Various devices can be used nowadays in displaying video content, which may comprise still and/or moving images. Such video display devices may comprise dedicated display devices, such as televisions (TVs), and/or devices with display capabilities, such as smartphones, tablet devices, laptops, personal computers (PCs), and/or industrial (or medical) devices with display screen for outputting data. The video display devices may display video content comprising locally generated content, content obtained from local sources, and/or content obtained from remote sources. In this regard, locally obtained video content may comprise content read from storage means, such as video content that may have been previously stored into Digital Video Discs (DVDs) and/or Blu-ray discs, and subsequently read therefrom using corresponding player devices, such as stand-alone DVD or Blu-ray players and/or optical disc drives (ODDs) integrated into or coupled to PCs or laptops. Video content obtained from remote sources may comprise content communicated and received via television broadcasts and/or broadband (e.g., Internet) telecasts or streams. Furthermore, in addition to video content obtained from remote or local sources, displayed video content may comprise content generated within or by the devices, such as video content corresponding to applications or programs executed by or on the devices. Additionally (or alternatively), content may be associated with use of interactive interfaces, such as with use of computers, smartphones, and/or game-console/video games, and as such the video content may be interactively generated. In some instances, video display devices may be used to concurrently display multiple video contents.

Further limitations and disadvantages of conventional and traditional approaches will become apparent to one of skill in the art, through comparison of such approaches with some aspects of the present method and apparatus set forth in the remainder of this disclosure with reference to the drawings.

BRIEF SUMMARY OF THE DISCLOSURE

A system and/or method is provided for record-time clipping optimization in display list structures, substantially as shown in and/or described in connection with at least one of the figures, as set forth more completely in the claims.

These and other advantages, aspects and novel features of the present disclosure, as well as details of illustrated implementation(s) thereof, will be more fully understood from the following description and drawings.

DETAILED DESCRIPTION

Figure 1:
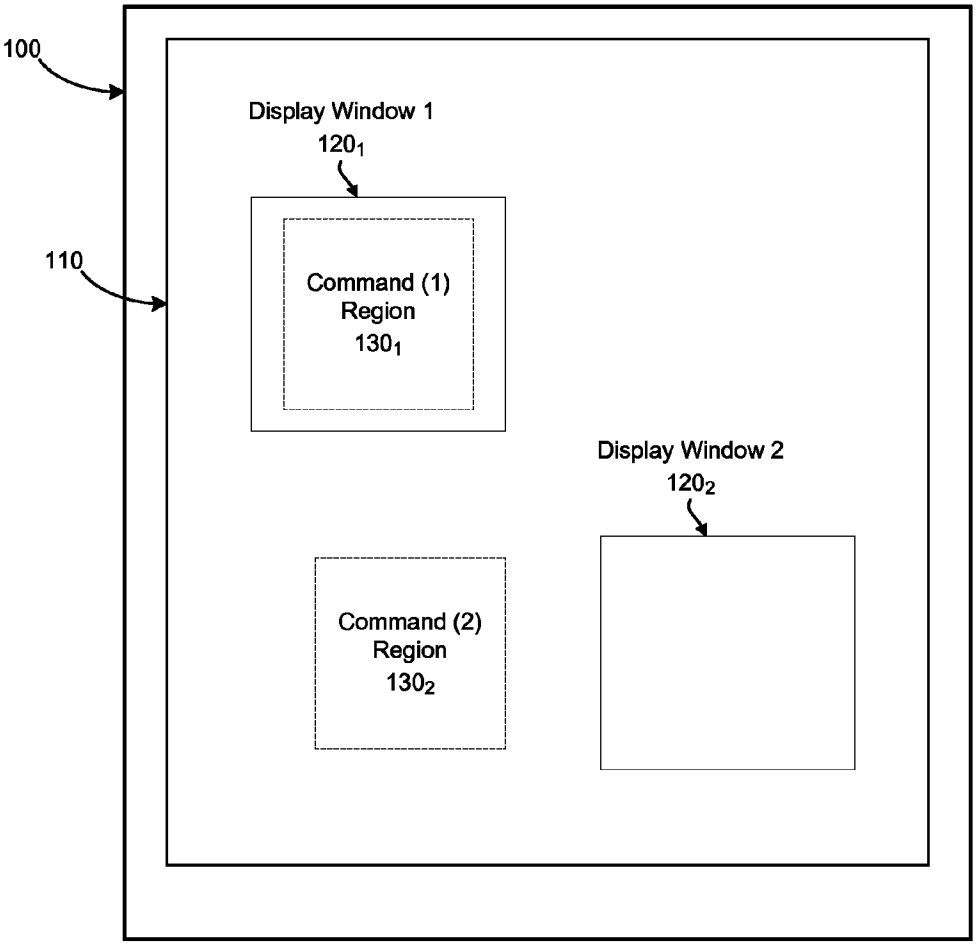
FIG. 1 is a block diagram illustrating an electronic device that comprises multiple-window display.

The present disclosure relates to a method and system for record-time clipping optimization in display list structures. In various implementations, an electronic device may enable optimizing handling of drawing commands. In this regard, handling optimization may comprise determining outcome of at least a portion of handling of a particular drawing command, which may be repeated in a series of lists of commands, based on preconfigured control information associated with the drawing command. The control information may be configured during generation and/or recordation of the series of lists of commands. The series of lists of commands may comprise a series of display lists for example. The portion of handling of the particular drawing command may comprise operations or functions, such as clipping operations, which may be performed during handling of the command for each iteration of the lists of commands. The control information may comprise, for example, handling flag indicating success or failure of the clipping operation. In this regard, determining whether to skip the particular command or not may be made based on the success or failure of the clipping operation. The control information may be incorporated into the particular drawing command itself. In this regard, the control information may be extracted from the drawing command during handling of the command for each iteration of the lists of commands. Alternatively, the control information may be stored into a separate structure, which may comprise a lookup table for example. In this regard, the separate structure may allow for storing and/or retrieving the control information, based on the drawing command. For example, the order of the command in the list of command may be used as index of the applicable control information entry in the lookup table.

As utilized herein the terms "circuits" and "circuitry" refer to physical electronic components (i.e. hardware) and any software and/or firmware ("code") which may configure the hardware, be executed by the hardware, and or otherwise be associated with the hardware. As utilized herein, "and/or" means any one or more of the items in the list joined by "and/or". As an example, "x and/or y" means any element of the three-element set {(x), (y), (x, y)}. As another example, "x, y, and/or z" means any element of the seven-element set {(x), (y), (z), (x, y), (x, z), (y, z), (x, y, z)}. As utilized herein, the terms "block" and "module" refer to functions than can be performed by one or more circuits. As utilized herein, the term "exemplary" means serving as a non-limiting example, instance, or illustration. As utilized herein, the term "e.g.," introduces a list of one or more non-limiting examples, instances, or illustrations.

FIG. 1 is a block diagram illustrating an electronic device that comprises multiple-window display. Referring to FIG. 1 there is shown an electronic device 100.

The electronic device 100 may comprise suitable logic, circuitry, interfaces, and/or code that may be operable to handle and/or run various applications and/or programs. In this regard, executing applications and/or programs by the electronic device 100 may be based on user instructions and/or pre-configured instructions. In some instances, the electronic device 100 may be operable to communicate data via wired and/or wireless connections, in accordance with one or more supported wireless and/or wired interfaces, protocols or standards. Examples of electronic devices may comprise cellular phones, smartphones, tablets, laptop computers, desktop or personal computers, televisions, personal media players, and/or other similar devices which may process, generate and/or output data. The disclosure, and/or any implementation(s) in accordance therewith, however, are not limited to any particular type of electronic devices.

The electronic device 100 may comprise a display 110, which may be used in outputting video or graphical data. In this regard, the display 110 may be utilized to display video content, which may comprise still and/or moving (stream of) images, and/or graphics (including, e.g., textual). The video content and/or graphics may comprise or correspond to input data read from storage device or received via broadcast or transmission to the electronic device; user interaction data, such as use menus or other graphic user interface (GUI) like functions; control related information, such as status or error related data; and/or data generated by and/or in conjunction with applications or programs run or executed by or on the electronic devices.

In some instances, the display 110 may support multi-window display operations. In this regard, multi-window display operations may comprise configuring multiple display regions (or windows), which may be used to concurrently display a plurality of video contents. The number and/or distribution of display regions may be configurable, such as based on user input and/or predetermine preferences, and/or may be dynamically adjusted during display operations. For example, the display windows $\mathbf{120}_1$ and $\mathbf{120}_2$ may be configured in the display 110, and may each be associated with one or more particular applications that may generate content and/or information that would be displayed only in the corresponding display window(s).

During display operation, application(s) in the electronic device 100 generating video or graphics outputted via the display 110 may issue commands for controlling and/or affecting the display operations. For example, commands issued by applications may comprise drawing commands, which may specify graphics, images, and/or video that may be displayed. In some instances, such drawing commands may specify a particular region in which the outputted data is to be display. For example, a first command, command (1), may specify a particular region ($\mathbf{130}_1$), whereas a second command, command (2), may specify a different region ($\mathbf{130}_2$). In situations where multi-windows environment is supported and/or utilized by the electronic device 100, the drawing commands may be associated with particular windows in the display 110, such as display windows $\mathbf{120}_1$ and $\mathbf{120}_2$. For example, command (1) may be associated with display window $\mathbf{120}_1$ whereas command (2) may be associated with display window $\mathbf{120}_2$. Accordingly, when handling drawing commands, such as commands (1) and (2), during video/graphics rending operations, a check may be performed to ensure that the regions specified by the commands coincide (intersect) with the associated display window(s). One way to perform that check is by use of clipping operation, which may be performed early when executing drawing commands. During clipping operations, the region specified by drawing command is compared with the allocated display window—if the boundaries of the region that needs to be drawn based on the command do not intersect with the current "clip region" (i.e., allocated display window) then the command is ignored. The "clip region" refers to a region of the screen defined by the system and/or the application as needing to be redrawn. Accordingly, use of clipping operation enables ignoring drawing command(s) that may not be related to particular changes, to the corresponding application, that may have occurred. Thus, in the example shown in FIG. 1, because command (1) region $\mathbf{130}_1$ is within the corresponding display window $\mathbf{120}_1$ that command is handled; whereas because command (2) region $\mathbf{130}_2$ is outside the corresponding display window $\mathbf{120}_2$ that command is ignored.

Performing clipping operations for individual command may not be too costly (e.g., in terms of resource use). However, in some instances, clipping operations may result in undesirable delays and/or unnecessary resource use. For example, display lists may be utilized by applications running in the electronic device 100. In this regard, a display list may be used to record a series of drawing commands used by an application to display its video/graphical data via the display 110. Display lists may sometimes be implemented in hierarchical manner—e.g., a display list may contain, or point to other display lists. When display lists are combined in such a way, they may generate series of useless or needlessly expensive operations, such as clipping operations. For example, the same drawing command may be included in all of the display lists. Thus, the clipping operation (e.g., determining that the command would be ignored) would be repeated multiple time even though the outcome of the clipping operation may be the same each time, resulting in multiple unnecessary repeats of the same clipping operation.

Accordingly, in various implementations, handling of drawing commands may be optimized in such scenarios (e.g., multiple display lists), such as by incorporating one or more mechanisms to enable avoiding unnecessarily performing particular functions or operations, such as the clipping operations. For example, particular handling information may be setup, during generation or recording of the display lists for example, specifying how to handle particular drawings commands whenever these commands are encountered. Such handling information may be incorporated into the commands themselves, for example, and/or may be associated with the command using separate/dedicated structures (e.g., lookup tables). These aspects are explained in more detail with respect to at least some of the following figures.

Figure 2:
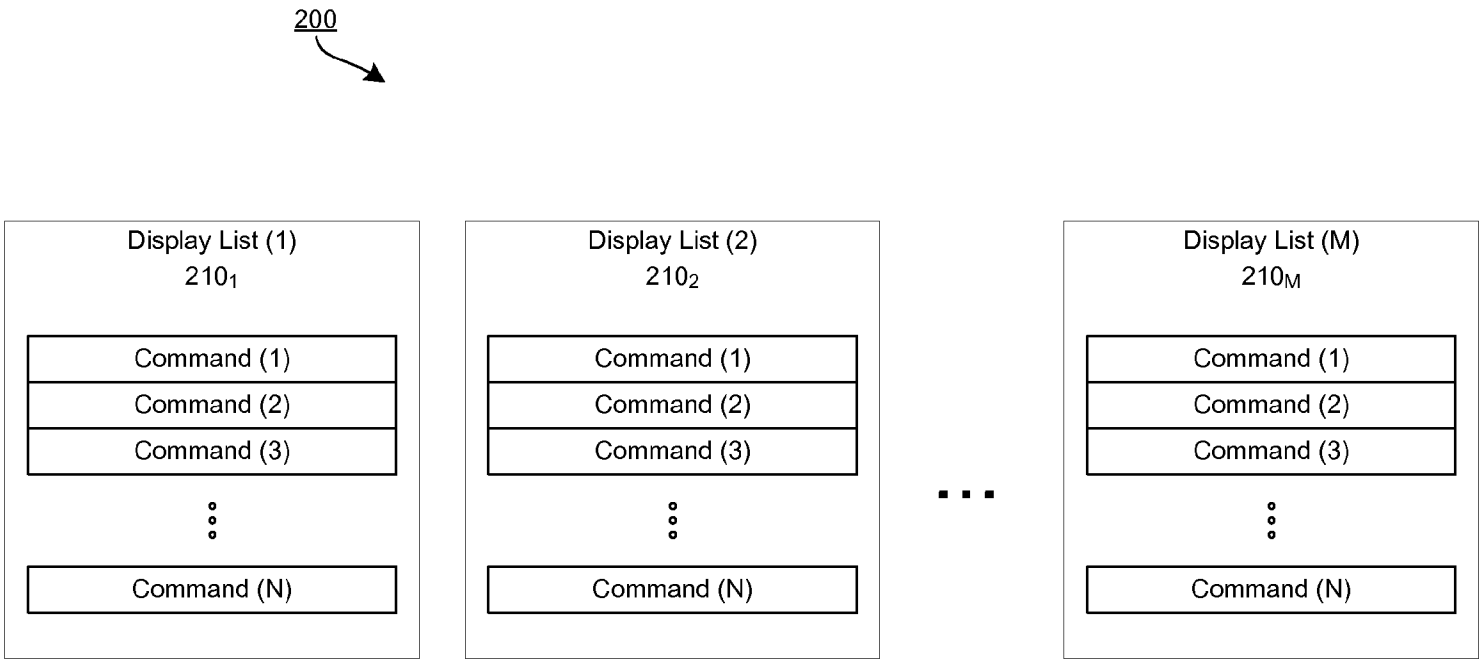
FIG. 2 is a block diagram illustrating a series of display lists.

FIG. 2 is a block diagram illustrating a series of display lists. Referring to FIG. 2, there is shown a series (200) of display lists $\mathbf{210}_1$-$\mathbf{210}_M$, with M being a non-zero natural number. The series 200 may be generated and/or configured by an application to display video data and/or graphics (e.g., user interface) associated therewith.

Each of the display lists may comprise a plurality of commands—e.g., command (1) to command (N). In some instances, at least some of the commands may comprise drawing commands, which may specify graphics, images, and/or video that may be displayed, and/or may further specify how the data is displayed—e.g., by specifying a particular screen region in which the outputted data is to be display. In some instances, at least some of the commands may be repeated in each of the display lists $210_1$-$210_M$. For example, the same drawing command may be used to refresh the command region after the same type of update.

Handling the commands 1-N in each iteration of the display lists $210_1$-$201_M$ may require performing particular functions and/or operations, such as clipping operations, as described with respect to FIG. 1. Because most commands may be repeated in each of the display list iterations 1-M, the same operation (e.g., clipping) may be repeated unnecessarily when handling the same command in iteration. Accordingly, in various implementations, handling of drawing commands in the multiple display lists $210_1$-$201_M$ may be optimized, such as by incorporating one or more measures to enable avoiding unnecessarily repeatedly performing particular functions or operations, such as the clipping operations. For example, particular handling information may be setup, during generation or recording of the display lists $210_1$-$201_M$, specifying, for example, how to handle particular commands whenever these commands are encountered during each iteration of the display lists $210_1$-$201_M$. Use of such handling information is described in more details in the following figures.

Figure 3:
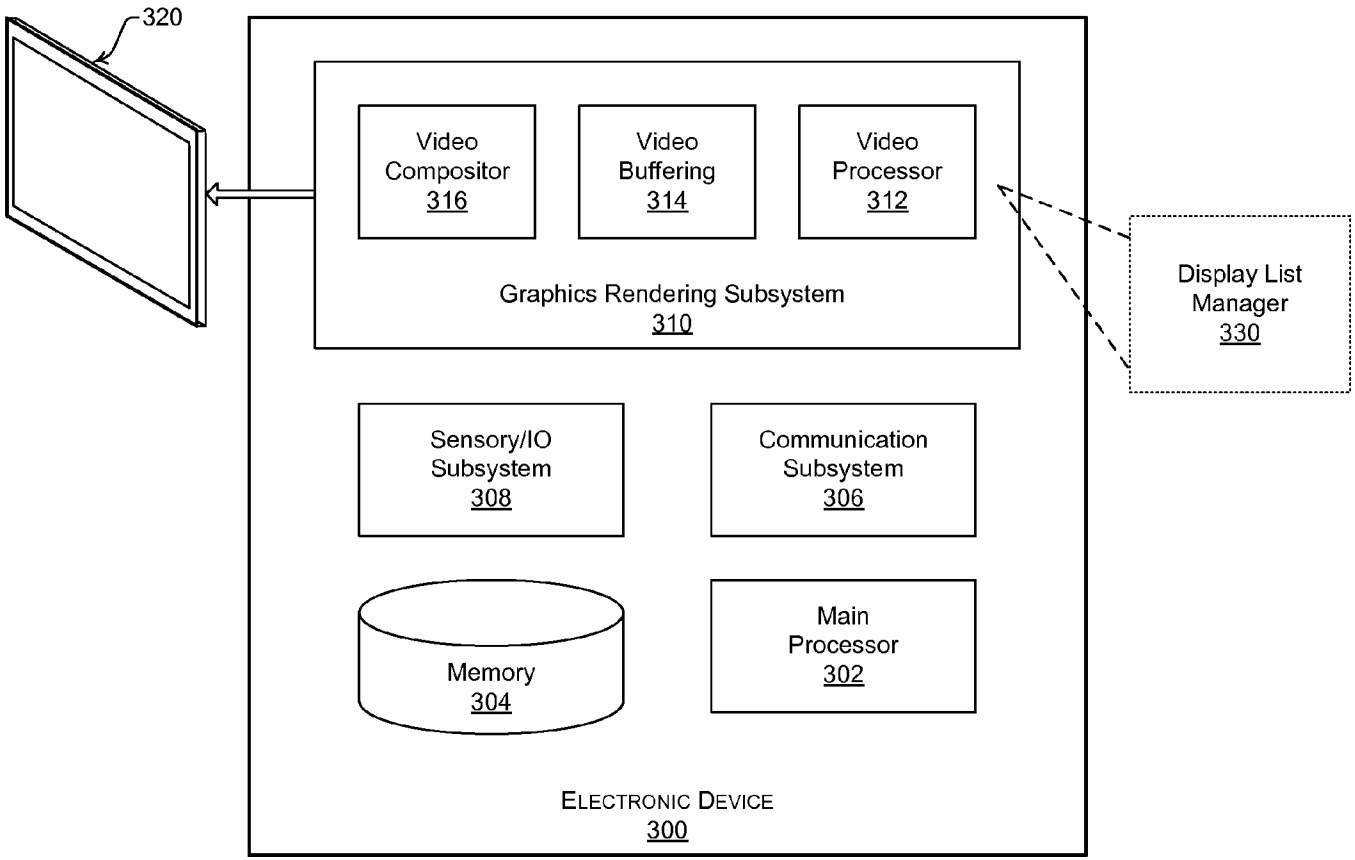
FIG. 3 is a block diagram illustrating an electronic device that provides optimized management of display lists during graphic rendering in multiple windows display.

FIG. 3 is a block diagram illustrating an electronic device that provides optimized management of display lists during graphic rendering in multiple windows display. Referring to FIG. 2 there is shown an electronic device 300.

The electronic device 300 may comprise suitable logic, circuitry, interfaces, and/or code that may be operable to implement various aspects of the disclosure. In this regard, the electronic device 300 may correspond to the electronic device 100 of FIG. 1. The electronic device 300 may comprise, for example, a main processor 302, a system memory 304, a communication subsystem 306, a sensory and input/output (I/O) subsystem 308, a graphics rendering subsystem 310, and a display 320.

The main processor 302 may comprise suitable logic, circuitry, interfaces, and/or code that may be operable to process data, and/or control and/or manage operations of the electronic device 300, and/or tasks and/or applications performed therein. In this regard, the main processor 302 may be operable to configure and/or control operations of various components and/or subsystems of the electronic device 300, by utilizing, for example, one or more control signals. The main processor 302 may enable running and/or execution of applications, programs and/or code, which may be stored, for example, in the system memory 304. Alternatively, one or more dedicated application processors may be utilized for running and/or executing applications (or programs) in the electronic device 300. In some instances, some of the applications running and/or executing on the electronic device 300 may generate and/or update video content that may be rendered via the display 320.

The system memory 304 may comprise suitable logic, circuitry, interfaces, and/or code that may enable permanent and/or non-permanent storage, buffering, and/or fetching of data, code and/or other information, which may be used, consumed, and/or processed. In this regard, the system memory 304 may comprise different memory technologies, including, for example, read-only memory (ROM), random access memory (RAM), Flash memory, solid-state drive (SSD), and/or field-programmable gate array (FPGA). The system memory 304 may store, for example, configuration data, which may comprise parameters and/or code, comprising software and/or firmware.

The communication subsystem 306 may comprise suitable logic, circuitry, interfaces, and/or code operable to communicate data from and/or to the electronic device, such as via one or more wired and/or wireless connections. The communication subsystem 306 may be configured to support one or more wired protocols (e.g. Ethernet standards) and/or wireless protocols or interfaces (e.g., Bluetooth, WiFi, cellular, WiMAX, and/or any available wireless protocol/interface), facilitating transmission and/or reception of signals to and/or from the electronic device 200, and/or processing of transmitted or received signals in accordance with applicable wired or wireless protocols. In this regard, signal processing operations may comprise filtering, amplification, analog-to-digital conversion and/or digital-to-analog conversion, up-conversion/down-conversion of baseband signals, encoding/decoding, encryption/decryption, and/or modulation/demodulation.

The sensory and I/O subsystem 308 may comprise suitable logic, circuitry, interfaces, and/or code for obtaining and/or generating sensory information, which may relate to the electronic device 300, its user(s), and/or its environment. For example, the sensory and I/O subsystem 308 may comprise positional or locational sensors (e.g., GPS or other GNSS based sensors), ambient condition (e.g., temperature, humidity, or light) sensors, and/or motion related sensors (e.g., accelerometer, gyroscope, pedometers, and/or altimeters). The sensory and I/O subsystem 308 may also incorporate input/output (I/O) functionality for enabling user interactions (e.g., visual, audio, and/or textual) with the electronic device 300, enabling obtaining input from user(s) and/or to providing output to the user(s)

The graphics rendering subsystem 310 may comprise suitable logic, circuitry, interfaces and/or code that may enable generating and/or processing of video content, and/or generating video frames based thereon for display, via the display 320 for example. The graphics rendering subsystem 310 may be implemented utilizing pipeline based architecture. In some instances, the graphics rendering subsystem 310 may support coordinated graphics rendering during multi-window display operations, substantially as described with respect to FIG. 1. The graphics rendering subsystem 310 may comprise, for example, a video processor 312, a video buffer 314, and a video compositor 316.

The video processor 312 may comprise suitable logic, circuitry, interfaces and/or code that may be operable to perform video processing operations on input video data (or content), to facilitate generation of corresponding output video data, which may be played via, for example, the display 320. For example, the video processor 312 may be operable to perform de-noising, de-blocking, restoration, deinterlacing and/or video sampling. In some instances, the video processor 312 may also perform decoding and/or decompression, such as when the input video data is received in encoded and/or compressed format. This may be achieved directly via the video processor 312 and/or via separate, dedicated video decoder component. The video buffer 314 may comprise suitable logic, circuitry, interfaces and/or code that may be operable to buffer video content during processing of video data and/or generation of output video data (frames) for display. In this regard, the video buffer 314 may be utilized to buffer video content corresponding to different screen regions (windows) in the display 320, which may be combined via the video compositor when generating video frames that are displayed via the display 320. The video compositor 316 may comprise suitable logic, circuitry, interfaces and/or code that may be operable to generate output video data (frames) for display based on video content received, handled, and/or processed via the graphics rendering subsystem 310. The video compositor 316 may also perform additional video processing operations, to ensure that generated output video steams may be formatted to suit the display 320. In this regard, the video compositor 316 may be operable to perform, for example, motion estimation and/or compensation, frame up/down-conversion, cropping, and/or scaling. In some instances, the video compositor 316 may be operable to generate and/or configure display frames that correspond to multi-window display operations. In this regard, the video compositor 316 may be operable to combine video contents corresponding to a plurality of display regions into single display frames. In this regard, the video contents utilized in generating the display frames may initially be copied into the video buffer 314, and copied from there by the video compositor 316 when generating the corresponding display frames.

The display 320 may comprise suitable logic, circuitry, interfaces and/or code that may enable displaying of video content, which may be handled and/or processed via the graphics rendering subsystem 310. In some instances, the display subsystem 320 may comprise a screen that may be configured for supporting multi-window display operations, in which multiple display regions may be configured to enable concurrently displaying a plurality of video contents. The number and/or distribution of display regions may be configurable, such as based on user input and/or predetermine preferences, and/or may be dynamically adjusted during display operations.

In some instances, electronic device 300 may comprise a display list manager 330. In this regard, the display list manager 330 may comprise suitable logic, circuitry, interfaces and/or code for use in optimizing handling of drawing related commands, such as by use of record-time handling pre-configuration, to specifying outcome of particular functions or operations (e.g., clipping operations) when repeatedly handling the same command(s). In this regard, pre-configured handling information may be generated, such as by the display list manager 330, to indicate outcome of one or more operations relating to and/or performed during handling of particular drawing command(s). In some instances, the display list manager 330 may be operable to incorporate the handling information into the commands themselves, and/or to store the handling information in separate/dedicated structures (e.g., lookup tables), such as within the system memory 304. The display list manager 330 may be implemented as software component (function) of the graphics rendering subsystem 310. Alternatively, the display list manager 330 may comprise a dedicated hardware and/or software component of the electronic device 300.

In operation, the electronic device 300 may support displaying video content and/or graphics associated with multiple applications. In this regard, one or more applications running in the electronic device 300 may be assigned to, and/or be associated with one or more display regions of the display 320. Such assignments need not be one-to-one. In other words, an application may be assigned multiple display regions, and/or a display region may be associated with more than one application. During display operations, display frames may be generated periodically, with each display frame comprising current video contents or graphics as available at time of frame publishing for example.

Application(s) running in the electronic device 300 generating video or graphics outputted via the display 320 may issue commands for controlling and/or affecting the display operations. For example, commands issued by applications may comprise drawing commands, which may specify graphics, images, and/or video that may be displayed. Handling the commands issued by the applications may entail performing particular functions or operations. For example, in some instances, such commands may specify a particular region in which the outputted data is to be display. In situations where multi-windows environment is supported and/or utilized by the electronic device 300, the drawing commands may be associated with particular windows in the display 320. Therefore, when handling drawing commands a check may be performed to ensure that the regions specified by the commands coincide (intersect) with the associated display window(s), such as by use of clipping operations.

In some instances, the commands issued by or associated with the applications may be configured into groups, such as display lists (e.g., display lists $\mathbf{210}_1$-$\mathbf{201}_M$ of FIG. 2). In some instances, the display lists associated with the applications may comprise repeated commands. Thus, handling at least some of the commands in each of the display lists may require repeatedly performing particular functions and/or operations relevant to handling the commands, such as clipping operations.

Accordingly, in various implementations, the display list manager 330 may be used in optimizing handling of commands in multiple display lists. In this regard, the display list manager may be operable to incorporate various measures that may enable avoiding unnecessarily repeatedly performing particular functions or operations, such as the clipping operations. The display list manager 330 may, for example, setup and/or configure handling information associated with particular commands during generation or recording of the display lists. In this regard, the handling information may specify, for example, how to handle the particular commands, such as by indicating outcome of particular operations and/or functions (e.g., clipping operations), thus obviating the need to repeat performance of these operations or functions for each display list. Such handling information may be incorporated into the commands themselves, for example. This is described in more details with respect to FIG. 4A. Alternatively, the preconfigured handling information may be associated with the command(s) using separate/dedicated structures (e.g., lookup tables). This is described in more detail with respect to FIG. 4B.

Figure 4A:
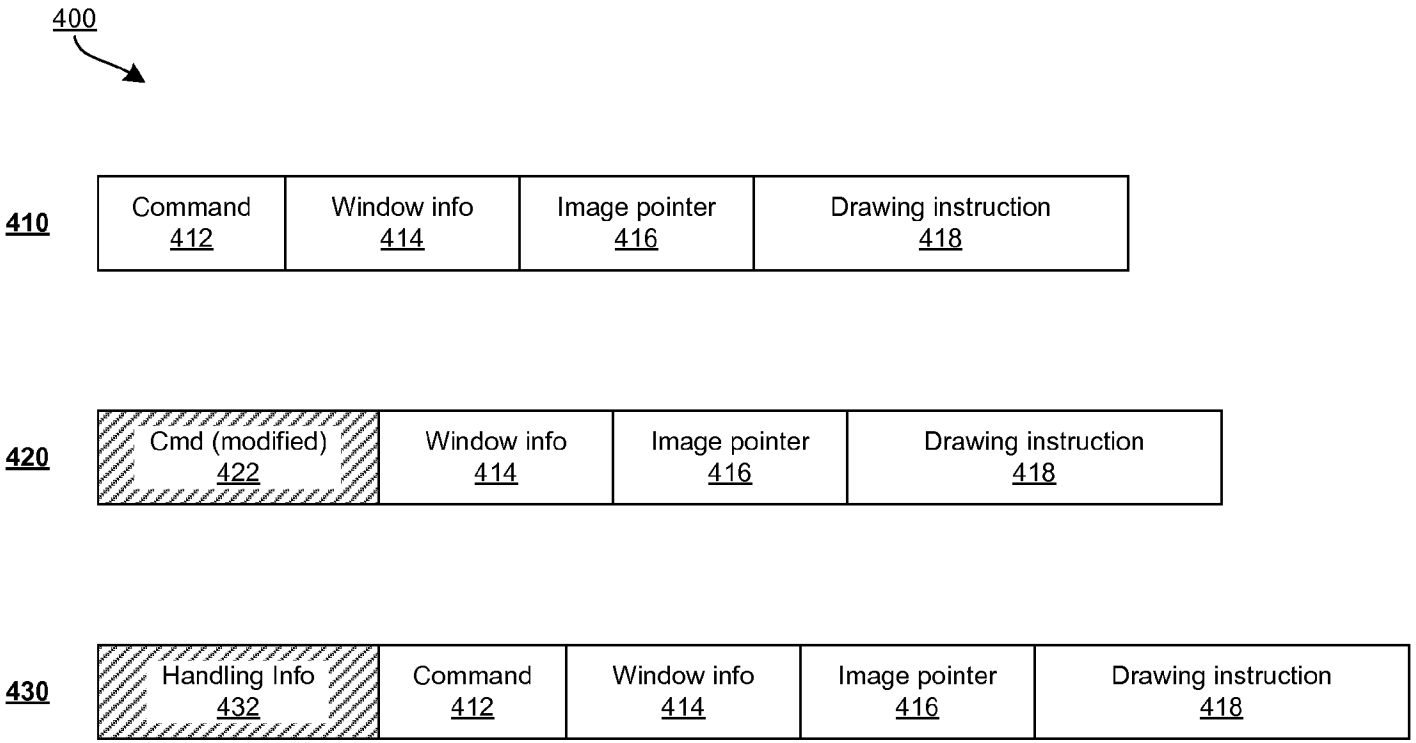
FIG. 4A is a block diagram illustrating modified command structures for optimizing handling of drawing commands in series of display lists.

FIG. 4A is a block diagram illustrating modified command structures for optimizing handling of drawing commands in series of display lists. Referring to FIG. 4A, there is shown command structures 410, 420, and 430.

Command structure 410 may represent original, unmodified commands as used without handling optimization. The command structure 410 may comprise a command operation code field 412; followed by window information field 414, which may comprise information relating to the window associated with the command (e.g., location and/or size of the window); an image pointer 416, which may point to the image or graphics that are to be displayed whenever the command is issued; and finally a drawing instructions field 418, which may comprise information pertaining to any particular instructions (e.g., how to draw the image or graphics pointed to by the command) that are applicable whenever the command is executed.

Command structure 420 may represent an implementation of modified commands that may be used for handling optimization. The command structure 420 may comprise a modified command operation code field 422 instead of the command operation code field 412, with the other fields remaining unchanged. In this regard, modified command operation code field 422 may be larger than the command operation code field 412, to allow for encoding of handling flags. For example, whereas the command operation code field 412 may be 2-byte field, the modified command operation code field 422 may be a 4-byte field, with the upper two bytes being allocated for setting handling flags, the lower two bytes being allocated to set the operation code. Use of the command structure 420 may require changes to the applications issuing the commands, to issue commands based on the modified structure. During handling of the command, the handlings may be extracted first (e.g., by OR'ing the modified command operation code field 422 with 0xffff0000 to mask off the operation code sub-field while keeping the handling flags sub-fields). The handling flags may then be used to determine if any particular handling outcome exists without having to handle the command fully. For example, if the handling flags sub-field comprises a clipping flag, and the clipping flag is set (to indicate clipping region mismatch), the command may simply and promptly be ignored.

Command structure 430 may represent another implementation of modified commands that may be used for handling optimization. The command structure 430 may comprise the same fields as the original command structure 410 (i.e., the command operation code field 412, the window information field 414, the image pointer 416, and the drawing instructions field 418). The command structure 430 may additionally comprise a handling flags field 432. The handling flags field 432 may be used for setting handling flags (e.g., the clipping flag). Accordingly, handling optimization may comprise adding (e.g., by the display list manager 330) the handling flags field 432 to issued commands (thus not requiring any changes to the applications issuing the commands). Extracting the handling information may simply entail processing the handling flags field 432 as any of the fields in the command structure 430. Nonetheless, the handling flags field 432 may be processed first, to optimizing handling of the command—e.g., by allowing ignoring the command in instances of clipping mismatches without requiring processing the remaining fields before the mismatch is detected (e.g., by comparing the clip region with the associated screen region(s) or window(s).

Figure 4B:
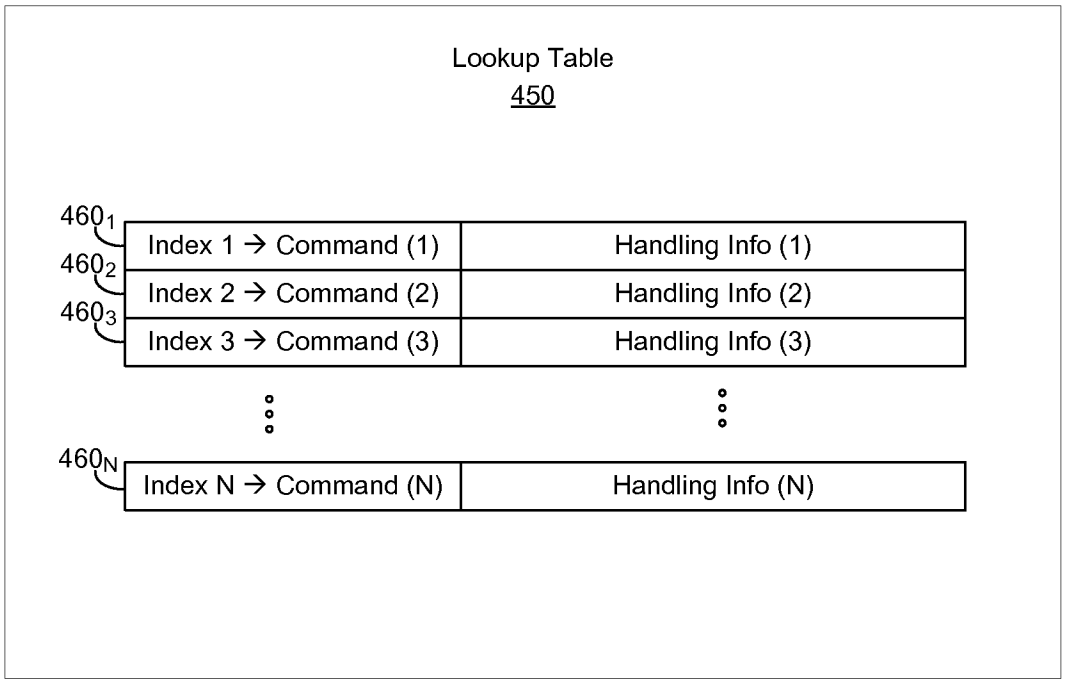
FIG. 4B is a block diagram illustrating lookup table structure for optimizing handling of drawing commands in series of display lists.

FIG. 4B is a block diagram illustrating lookup table structure for optimizing handling of drawing commands in series of display lists. Referring to FIG. 4B, there is shown a lookup table 450.

The lookup table 450 may comprise plurality of entries $\mathbf{460}_1$-$\mathbf{460}_N$. Each entry $\mathbf{460}_x$ may comprise an index field and a handling information field. The lookup table 450 may be utilized for enabling command handling optimization. However, instead of encoding the handling information in the commands themselves, use of the lookup table 450 may enable encoding the handling information in a separate data structure, thus leaving issuance and processing of the command unaltered. In this regard, an instance of the table 450 may be maintained by the display list manager 330 to setup preconfigured handling information for commands in the display lists, especially in repeated display lists scenarios. The preconfigured handling information may then be used to expedite handling of the commands by enabling determining when to skip the command based on predetermined outcome of particular operation (e.g., clipping operation). For instance, the command index field of a particular lookup table entry $\mathbf{460}_x$ may be used to map the lookup table entry to particular command in a display list (e.g., based on the command order in the display list). In other words, index (3) in the lookup table 450 (i.e., index field of lookup table entry $\mathbf{460}_3$) may map the lookup table entry $\mathbf{460}_3$ to command (3) in each of the display lists $\mathbf{210}_1$-$\mathbf{210}_M$. The handling information field of the lookup table entry $\mathbf{460}_x$ may then be used for setting handling information for the corresponding command. Accordingly, during handling of particular command in a display list, the command's index in the display list (e.g., order within the list) may be used as pointer into the corresponding the entry in the lookup table 450, and the handling information field of mapped lookup table entry may then be extracted to determined how the command is handled (e.g., if it is skipped).

Figure 5:
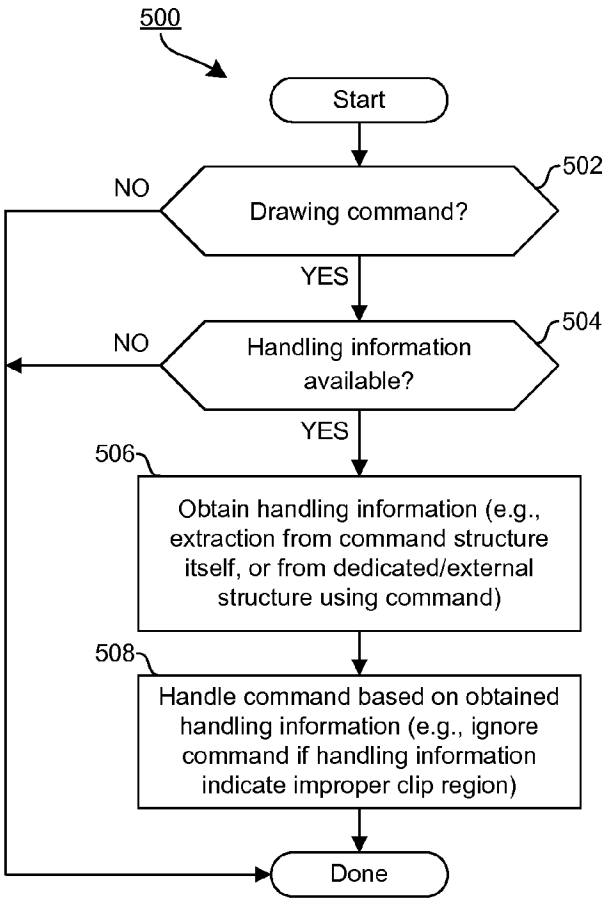
FIG. 5 is a flow chart that illustrates handling of drawing commands in accordance with record-time clipping optimization.

FIG. 5 is a flow chart that illustrates handling of drawing commands in accordance with record-time clipping optimization. Referring to FIG. 5, there is shown a flow chart 500 comprising a plurality of exemplary steps for optimizing clipping operations in an electronic device, such as device 300.

In step 502, a check whether a presently handled command is a drawing command may be performed. In instances where it may be determined that the present command is a drawing command, the process may be proceed (to step 504); otherwise the process may terminate. In step 504, a check whether preconfigured handling information is available may be performed. In instances where it may be determined that preconfigured handling information for the present command is available, the process may be proceed (to step 506); otherwise the process may terminate.

In step 506, the preconfigured handling information for the present command may be obtained. This may be done, for example, by extracting the preconfigured handling information from the present command itself in instances where that information is incorporated into the command (as shown in FIG. 4A); or by obtaining the preconfigured handling information from a dedicated/external structure, such as the lookup table 450 of FIG. 4B, by using the present command index in the pertinent display list as index of the corresponding entry in the lookup table 450. In step 508, the present command may be handled based on obtained preconfigured handling information. For example, the preconfigured handling information may specify outcome of clipping operation applicable to the present command (e.g., specifying that the command is ignored due to improper clip region).

Other implementations may provide a non-transitory computer readable medium and/or storage medium, and/or a non-transitory machine readable medium and/or storage medium, having stored thereon, a machine code and/or a computer program having at least one code section executable by a machine and/or a computer, thereby causing the machine and/or computer to perform the steps as described herein for record-time clipping optimization in display list structures.

Accordingly, the present method and/or system may be realized in hardware, software, or a combination of hardware and software. The present method and/or system may be realized in a centralized fashion in at least one computer system, or in a distributed fashion where different elements are spread across several interconnected computer systems. Any kind of computer system or other system adapted for carrying out the methods described herein is suited. A typical combination of hardware and software may be a general-purpose computer system with a computer program that, when being loaded and executed, controls the computer system such that it carries out the methods described herein.

The present method and/or system may also be embedded in a computer program product, which comprises all the features enabling the implementation of the methods described herein, and which when loaded in a computer system is able to carry out these methods. Computer program in the present context means any expression, in any language, code or notation, of a set of instructions intended to cause a system having an information processing capability to perform a particular function either directly or after either or both of the following: a) conversion to another language, code or notation; b) reproduction in a different material form.

While the present method and/or apparatus has been described with reference to certain implementations, it will be understood by those skilled in the art that various changes may be made and equivalents may be substituted without departing from the scope of the present method and/or apparatus. In addition, many modifications may be made to adapt a particular situation or material to the teachings of the present disclosure without departing from its scope. Therefore, it is intended that the present method and/or apparatus not be limited to the particular implementations disclosed, but that the present method and/or apparatus will include all implementations falling within the scope of the appended claims.

What is claimed is:

1. A method, comprising:

generating a series of lists of commands using a graphics rendering subsystem of an electronic device, wherein:

at least some commands in the series of lists of commands are drawing commands, and one or more of the drawing commands are repeated in at least some of the lists of commands;

determining an outcome of a clipping operation for at least one of the repeated drawing commands using the graphics rendering subsystem;

prior to execution of the series of lists of commands, configuring control information associated with at least one of the repeated one or more drawing commands using the graphics rendering subsystem, wherein the control information is configured based on the determined outcome of the clipping operation for a corresponding drawing command; and executing the series of lists of commands using the graphics rendering subsystem, wherein the executing comprises:

checking for each command whether it is a drawing command, when the command is a drawing command, checking for presence of a corresponding control information, and when a corresponding control information is present, determining based on the control information when to ignore the command.

2. The method of claim 1, wherein the series of lists of commands comprises a series of display lists.

3. The method of claim 1, wherein the control information comprises one or more flags indicating success or failure of the clipping operation.

4. The method of claim 3, comprising determining whether to ignore the drawing command based on the success or failure of the clipping operation.

5. The method of claim 1, wherein the control information is incorporated into the corresponding drawing command itself.

6. The method of claim 5, comprising extracting the control information from the corresponding drawing command during handling of the corresponding drawing command for each of the lists of commands.

7. The method of claim 1, comprising storing the control information into a separate structure.

8. The method of claim 7, wherein the separate structure comprises a lookup table.

9. The method of claim 7, wherein the separate structure allows for storing and retrieving the control information based on the drawing command.

10. An electronic device, comprising:

a display;

at least one processor; and a memory containing executable instructions that when executed by the at least one processor cause the electronic device to perform a method for managing command executions in the electronic device, the method comprising:

generating a series of lists of commands, wherein:

at least some commands in the series of lists of commands are drawing commands, and one or more of the drawing commands are repeated in at least some of the lists of commands;

determining an outcome of a clipping operation for at least one of the repeated drawing commands;

configuring prior to execution of the series of lists of commands control information associated with at least one of the repeated one or more drawing commands, wherein the control information is configured based on the determined outcome of the clipping operation for a corresponding drawing command; and executing the series of lists of commands, wherein the executing comprises:

checking for each command whether it is a drawing command, when the command is a drawing command, checking for presence of a corresponding control information, and when a corresponding control information is present, determining based on the control information when to ignore the command.

11. The electronic device of claim 10, wherein the series of lists of commands comprises a series of display lists.

12. The electronic device of claim 10, wherein the control information comprises one or more flags indicating success or failure of the clipping operation.

13. The electronic device of claim 12, comprising determining whether to ignore the drawing command based on the success or failure of the clipping operation.

14. The electronic device of claim 10, wherein the control information is incorporated into the corresponding drawing command itself.

15. The electronic device of claim 14, comprising extracting the control information from the corresponding drawing command during handling of the corresponding drawing command for each of the lists of commands.

16. The electronic device of claim 10, comprising storing the control information into a separate structure.

17. The electronic device of claim 16, wherein the separate structure comprises a lookup table.

18. The electronic device of claim 16, wherein the separate structure allows for storing and retrieving the control information based on the drawing command.

19. A method, comprising:

generating a series of display lists using a graphics rendering system of an electronic device, wherein:

one or more drawing commands are repeated in at least some of the display lists, and the display lists are generated in a hierarchical manner;

determining an outcome of a clipping operation for at least one of the repeated drawing commands using the graphics rendering subsystem; and configuring during recording of the display lists control information associated with at least one of the repeated drawing commands using the graphics rendering subsystem, wherein:

the control information is configured based on the determined outcome of the clipping operation for a corresponding drawing command, and the determined outcome of the clipping operation enables skipping the corresponding drawing command when encountered during execution of each of the series of display lists.

20. The method of claim 19, comprising incorporating the control information into the corresponding drawing command itself.

21. The method of claim 19, comprising storing the control information into a lookup table, at index corresponding to a position of the corresponding drawing command within each of the at least some of the display lists in which the corresponding drawing command is repeated.

22. A method, comprising:

determining, by a graphics rendering subsystem of an electronic device, a predetermined outcome of a clipping operation for a particular drawing command that is repeated in a series of lists of commands, wherein the predetermined outcome is determined based on preconfigured control information associated with the particular drawing command, wherein the control information is preconfigured during generation of the series of lists of commands based on success or failure of the clipping operation for the particular drawing command.

23. The method of claim 22, wherein the series of lists of commands comprises a series of display lists.

24. The method of claim 22, wherein the control information comprises one or more flags indicating success or failure of the clipping operation.

25. The method of claim 24, comprising determining whether to skip the particular drawing command based on the success or failure of the clipping operation.

26. The method of claim 22, wherein the control information is incorporated into the particular drawing command itself.

27. The method of claim 22, wherein the control information is stored into a separate structure.

* * * * *